US006742608B2

(12) United States Patent
Murdoch

(10) Patent No.: US 6,742,608 B2
(45) Date of Patent: Jun. 1, 2004

(54) ROTARY MINE DRILLING BIT FOR MAKING BLAST HOLES

(76) Inventor: Henry W. Murdoch, 4627 Mimosa, Bellaire, TX (US) 77401

( * ) Notice: Subject to any disclaimer, the term of this patent is extended or adjusted under 35 U.S.C. 154(b) by 0 days.

(21) Appl. No.: 10/264,953

(22) Filed: Oct. 4, 2002

(65) Prior Publication Data

US 2004/0065481 A1 Apr. 8, 2004

(51) Int. Cl.[7] ..... E21B 10/22; E21B 10/08

(52) U.S. Cl. ..... 175/413; 175/366; 175/367; 175/368

(58) Field of Search ..... 175/327, 331, 175/342, 366–368, 382, 412, 413

(56) References Cited

U.S. PATENT DOCUMENTS

| | | | | | |
|---|---|---|---|---|---|
| 1,636,668 | A | | 7/1927 | Reed | |
| 1,636,669 | A | | 7/1927 | Blauvelt | |
| 1,649,858 | A | | 11/1927 | Reed | |
| 1,729,063 | A | | 9/1929 | Bull | |
| 1,802,872 | A | | 4/1931 | Bull | |
| 1,909,925 | A | | 5/1933 | Abegg | |
| 1,992,992 | A | | 3/1935 | Collins | |
| 2,061,933 | A | * | 11/1936 | Crum | 175/363 |
| 2,064,273 | A | * | 12/1936 | Scott | 175/339 |
| 2,065,743 | A | | 12/1936 | Reed | |
| 2,318,370 | A | * | 5/1943 | Burch | 175/366 |
| 2,648,526 | A | * | 8/1953 | Lanchester | 175/340 |
| 2,890,020 | A | | 6/1959 | Hawthorne et al. | |
| 3,765,495 | A | | 10/1973 | Murdoch et al. | |
| 3,971,600 | A | | 7/1976 | Murdoch et al. | |
| 4,630,693 | A | * | 12/1986 | Goodfellow | 175/366 |
| 5,137,097 | A | * | 8/1992 | Fernandez | 175/228 |
| 5,199,516 | A | * | 4/1993 | Fernandez | 175/366 |
| 5,224,560 | A | * | 7/1993 | Fernandez | 175/374 |
| 5,595,255 | A | * | 1/1997 | Huffstutler | 175/331 |
| 5,624,002 | A | * | 4/1997 | Huffstutler | 175/356 |
| 5,641,029 | A | * | 6/1997 | Beaton et al. | 175/356 |
| 5,755,297 | A | * | 5/1998 | Young et al. | 175/331 |
| 6,131,676 | A | * | 10/2000 | Friant et al. | 175/371 |

* cited by examiner

*Primary Examiner*—David Bagnell
*Assistant Examiner*—Jennifer H Gay
(74) *Attorney, Agent, or Firm*—Fulbright & Jaworski

(57) ABSTRACT

A rotary mine drilling bit for making blast holes having a connection at one end of the body for attachment to a drill string and the second end of the body having a plurality of longitudinally extending slots. A thrust shoulder is provided between the ends of the body and longitudinally extending supporting legs are positioned in each of the slots and are releasably connected to the body. One end of the supporting legs are positioned the adjacent the shoulders for receiving longitudinal thrust and for avoiding thrust on the connecting means. A roller bit is connected to the end of each supporting leg.

6 Claims, 6 Drawing Sheets

60
20
16
10
12
30
30
52
24
22
22
18
26
26
32
32
35
34
34
35
35

ROTARY MINE DRILLING BIT FOR MAKING BLAST HOLES

BACKGROUND OF THE INVENTION

The present invention is directed to a rotary mine drilling bit for making blast holes in which the parts are separable and replaceable in the field thereby providing a bit in which the part are reusable and consequently provide lower bit costs. In particular, the bit includes bit supporting legs positioned in longitudinally extending slots; releasable connecting means holding the legs in the slots without requiring the connecting means to bear the thrust loads of operating bit.

Various types of roller bits are used for drilling into the earth's surface. For example, integrally and permanently assembled roller bits are used in the oil and gas industry for drilling wells. Such bits may drill into the earth's surface as much as several miles and such bits are not taken apart but are generally operated until they are worn out and are then discarded. Similar type bits are used as mine drilling bits for drilling blast holes in which explosives are inserted into the blast holes to break up the formation for collection. Such blast holes are generally shallow, for example, 50 to 100 feet. However, the use of integral or one-piece drilling bit are not readily reparable and as such are expensive. The blast holes are readily available for inspection after digging each blast hole. If parts become worn or broken, they would be available for repair or replacement if suitably constructed with releasably connected parts.

BRIEF SUMMARY OF THE INVENTION

The present invention is directed to a rotary mine drilling bit for making blast holes in which the more likely parts to be broken or worn may be replaced in the field.

Still a further object of the present invention is wherein the rotary mine drilling bit of the present invention includes an integral body having a longitudinal axis and one end of the body includes a connection for attachment to a drill string. A second end of the body includes a plurality of longitudinally extending slots on the periphery of the second end and a transversely extending thrust shoulder is provided on the body intermediate the ends of the body. Transversely extending connecting means is provided between each of the supporting legs and the second end of the body for releasably connecting the legs to the body and one end of the supporting legs is positioned to engage the thrust shoulder for receiving a longitudinal thrust of the body from a drilling string. A roller bit is connected to the second end of each supporting leg.

Yet a still further object of the present invention is wherein the roller bits are releasably connected to each leg.

Still a further object is wherein the slots are formed by first and second longitudinally extending fins extending outwardly from the body on opposite side of each slot. Preferably, the first and second fins extend outwardly in a diverging direction from each other forming diverging shoulders on opposite sides of each slot and the supporting legs include diverging sides for mating with coacting diverging shoulders when the legs are positioned in one of the slots. Preferably, the angle included between first and second fins is approximately 90 degrees.

Yet a further object is wherein each of the legs includes an inside side which is spaced from contact with the body for insuring that the diverging sides of the legs coact and mate securely with the diverging shoulders on opposite sides of each slot.

Yet a still further object of the present invention is wherein the connecting means include one or more bolts for each of the legs connected to the fins and extending through openings in the legs and openings in the fins wherein the openings are larger than the bolts for insuring that the one ends of the supporting legs engage the thrust shoulder whereby the bolts are not required to bear thrust loads.

Still a further object of the present invention is wherein the body includes a longitudinally extending axial opening therethrough and a longitudinal passageway exteriorly of the body positioned between adjacent legs for allowing the removal of debris from the blast hole.

Yet a still further object of the present invention is wherein the bolts are tightened sufficiently to hold the legs in place by friction between adjacent fins.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which:

FIG. 7 is an enlarged fragmentary view of the area 7 of FIG. 6.

DETAILED DESCRIPTION OF THE INVENTION

Figure 2:
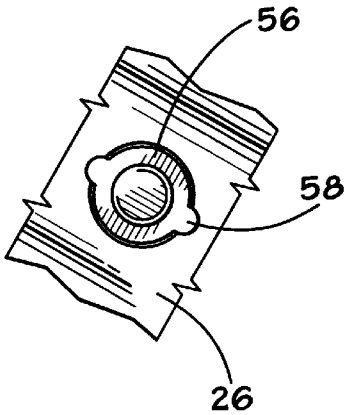
FIG. 2 is a view taken along the line 2—2 of FIG. 1.

Referring now to FIGS. 1, 3, 4, and 5, the reference numeral 10 generally indicates the rotary mine drilling bit of the present invention for making blast holes in the surface of the earth such as in mining iron. The numeral 12 generally indicates an integral metal body having a longitudinal axis 14, a first end 16 and a second end 18. The first end 16 includes a connection such as threads 20 (FIGS. 3 and 5) such as BECO type although any suitable connection may be used for attachment to a drill string (not shown).

Figure 1:
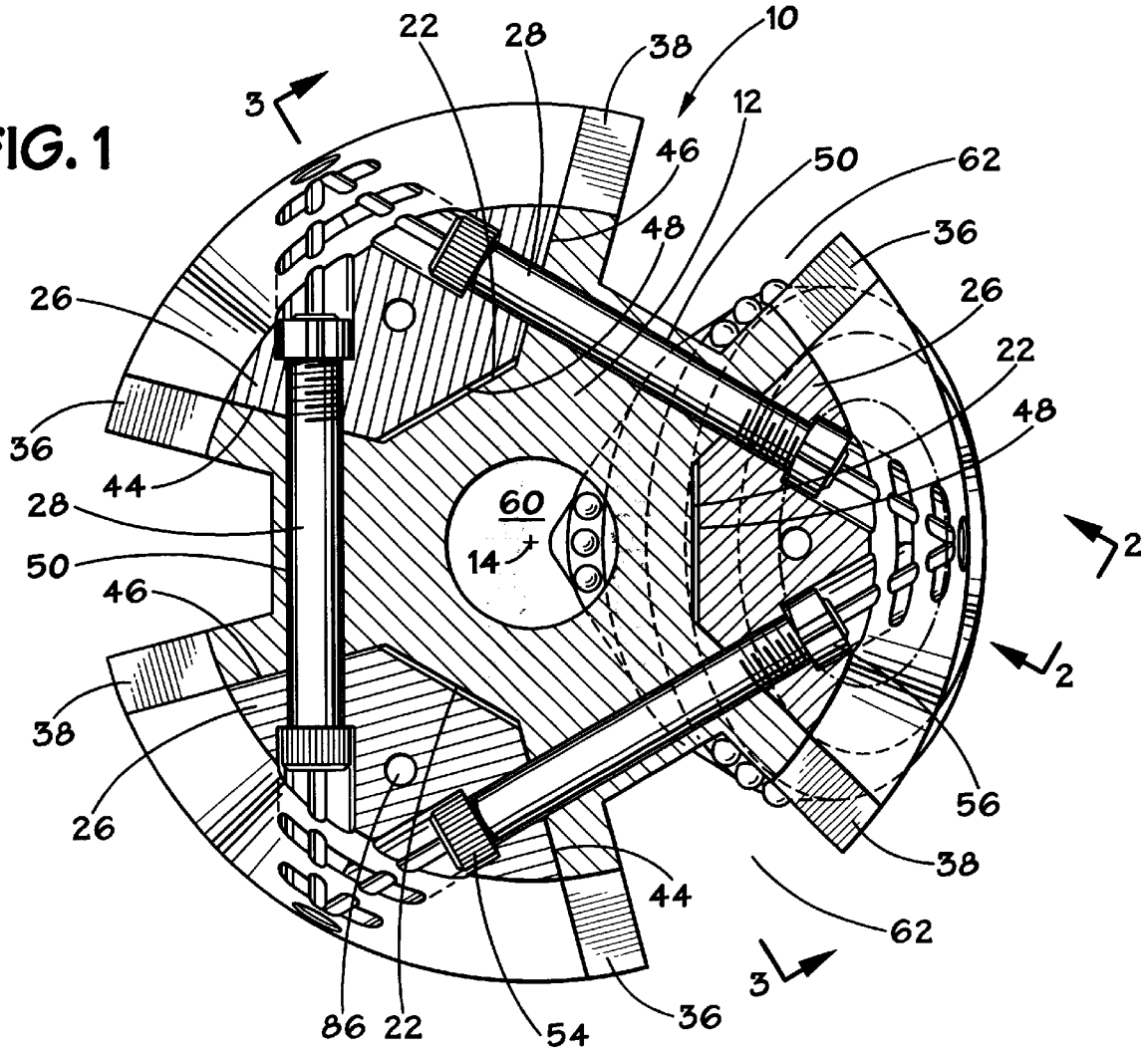
FIG. 1 is a cross-sectional view of the present invention.
Figure 9:
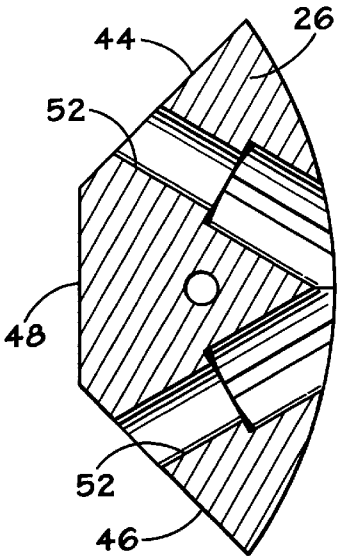
FIG. 9 is a cross-sectional view taken along the line 9—9 of FIG. 6.
Figure 10:
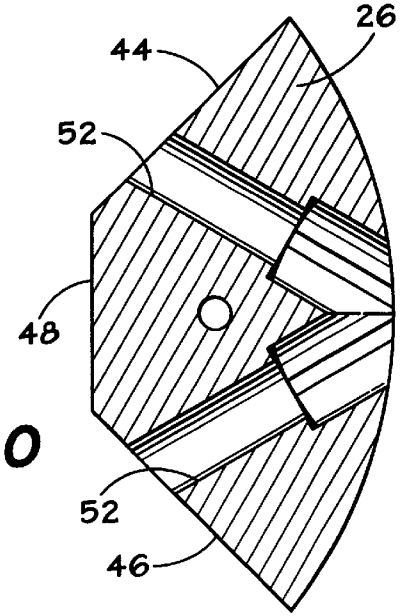
FIG. 10 is a cross-sectional view taken along the line 10—10 of FIG. 6.
Figure 3:
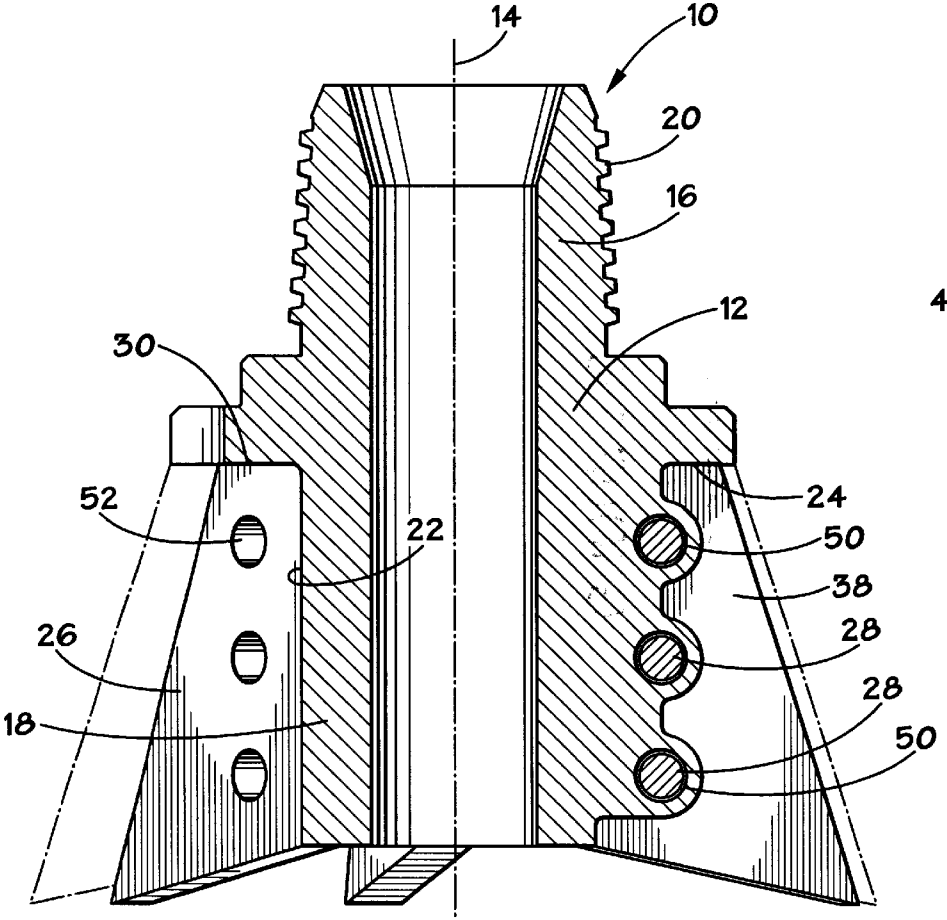
FIG. 3 is a view taken along the line 3—3 of FIG. 1.
Figure 5:
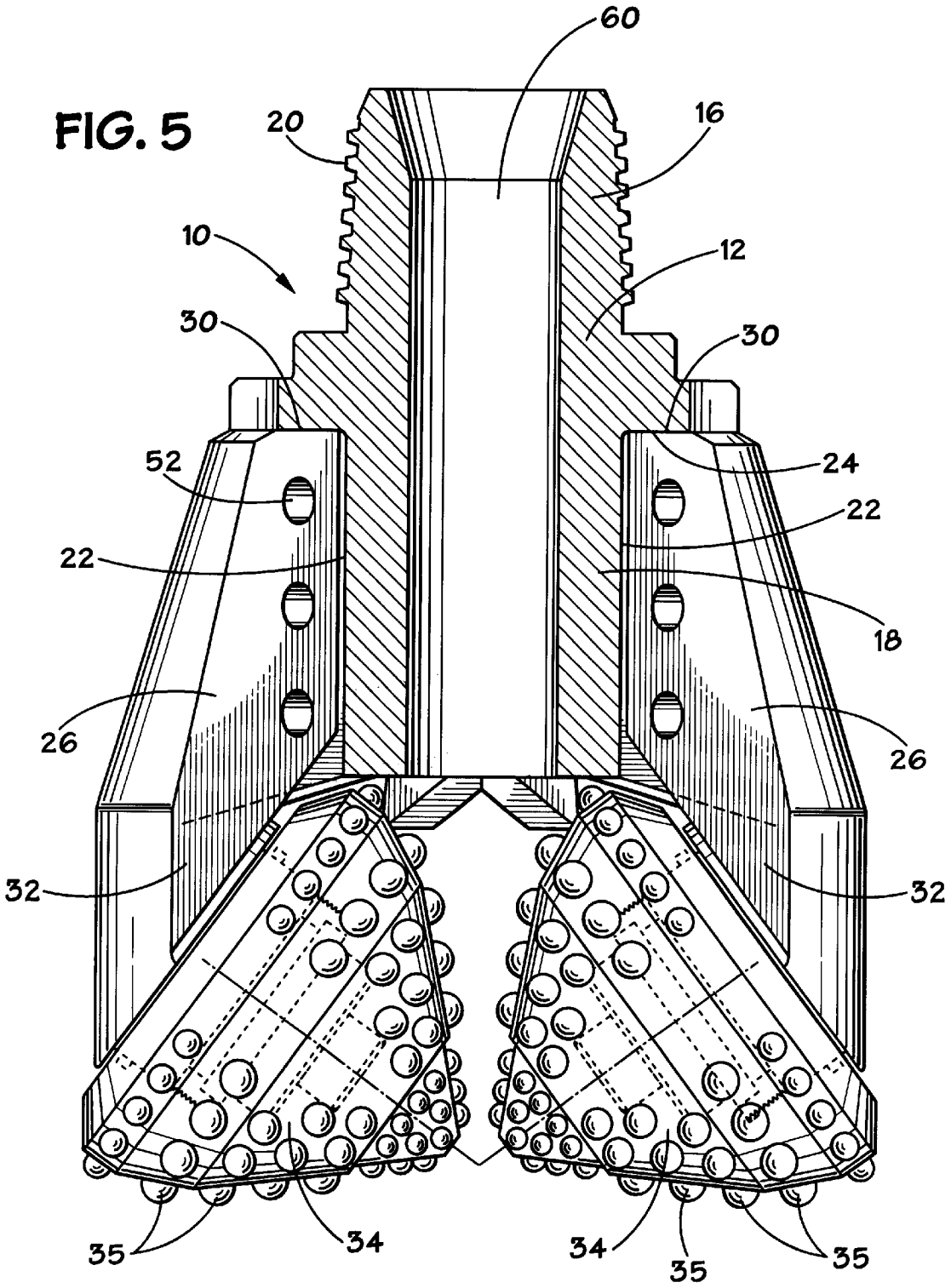
FIG. 5 is a view taken along the line 5—5 of FIG. 4.

The second end 18 of the body 12 includes a plurality of longitudinally extending slots 22 on the periphery of the second end 18, as best seen in FIGS. 1, 3 and 5. While any suitable number of slots 22 may be used, as shown here in the preferred embodiment, the number of slots are three. A transversely extending thrust shoulder 24, as best seen in FIGS. 3 and 5 is provided on the body 12 intermediate the ends 16 and 18. The purpose of the shoulder 24 is to provide a downward thrust from a drill string for drilling into a formation. A longitudinally extending support leg 26 is positioned in each of the longitudinally extending slots 22. The support legs 26 are connected by a transversely extending connecting means such as bolts 28 to the second end 16 of the body 12 for releasably connecting the legs 26 to the body 12. The support legs 26, as best seen in FIGS. 3 and 5, include a first end 30, as best seen in FIGS. 3 and 5, positioned to engage the thrust shoulder 24 for receiving a longitudinal downward thrust of the body 12 from a drill string. A roller bit 34 is connected to a second end 32 of each support legs 26 for conventionally drilling a blast hole as a drill string rotates and provides a downward thrust to the body 12.

Preferably, the roller bits 34, which may be conventional roller bits having a plurality of tungsten carbide inserts 35, are releasably connected to each support leg 26 as will be more fully described hereinafter. Thus, after the drill bit 10 is removed from a blast hole, it may be inspected and if need be the support legs 26 and/or the roller bits 34 may be replaced in the field whereby the bit 10 is always operating at optimum and the more wearable parts may be replaced without replacing or discarding the entire bit 10.

Figure 4:
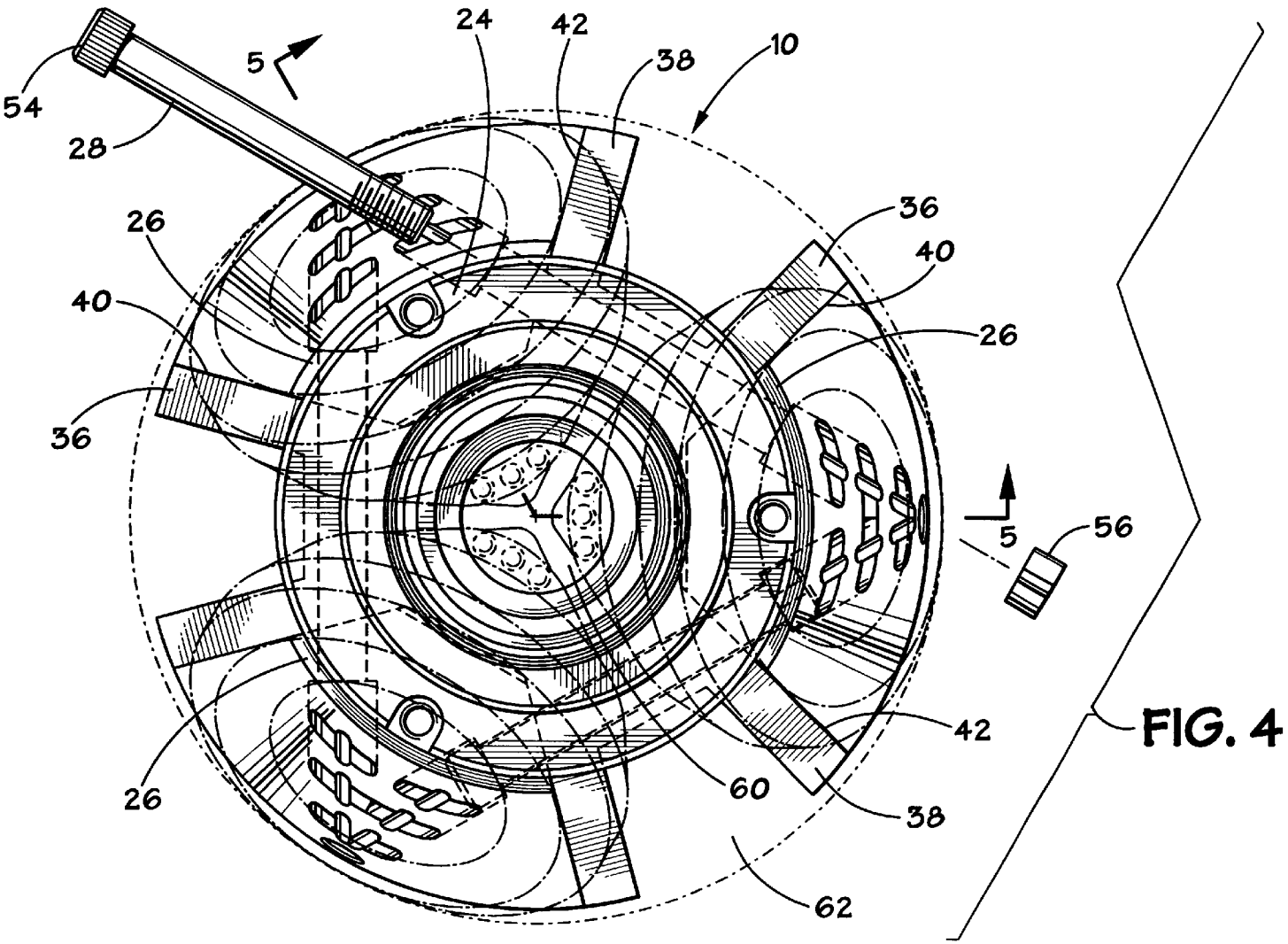
FIG. 4 is a top view, partly exploded, of the present invention.

Referring now to FIGS. 1 and 4, the longitudinally extending slots 22 on the body 12 are formed by first and second longitudinally extending fins extending outwardly from the body 12 on opposite sides of each slot 22. Therefore, a first fin 36 and a second fin 38 extend outwardly from the body 12 on opposite sides of each slot 22 for forming the slots 22. In addition, the first fins 36 and the second fins 38 extend outwardly in a diverging direction from each other forming diverging shoulders 40 and 42, respectively, on opposite sides of each slot 22. And in addition the supporting legs 22 include diverging sides 44 and 46, respectively, for coacting with the diverging shoulders 40 and 42, respectively when the legs 26 are positioned in one of the slots 22. Preferably, the angle included between each first fin 36 and coacting second fin 38 is approximately 90 degrees. Each of the legs 26 include an inside side 48 which is preferably spaced out of contact with the body 12. While it would be desirable that the inside side 48 contact the body 12 for additional support manufacturing tolerances are not sufficient. That is, it is more important that the diverging sides 44 and 46 on the support legs 26 engage and coact firmly with the diverging shoulders 40 and 42, respectively, of the fins 36 and 38, respectively. This becomes important as the supporting legs 26 are secured in a coacting slot 22 by one or more bolts 28.

Referring now to FIGS. 1–6, and 9 and 10, it is to be noted that the bolts 28 extend through openings 50 in the body 12 and through openings 52 in the support legs 26. The bolts 28 include a head 54 and a nut 56. Preferably, the head 54 includes an allenhead recess and the nuts 56 include an irregular shoulder 58 for tightening the bolts 28. It is to be noted that the openings 50 in the body and the openings 52 in the supporting legs 26 are larger than the diameter of the bolts 28 thereby insuring that only tensile forces are applied to the bolts 28. The supporting legs 26 are secured in place in the slots 22 by tightening the bolts 28 sufficiently so that the coacting diverging shoulders 40 and 42 frictionally engage the diverging sides 44 and 46, respectively, sufficiently to hold the support legs 26 in position. This also insures that since the first end 30 of the support legs 26 engage the thrust shoulder 24, any thrust forces on the bolts 28 is avoided.

While the bolts 28 serve as a backup to keep the legs 26 in the slots 22, it is preferable that all of the forces exerted on the bolts are in tension and thrust and moment forces are avoided. Rotation of the drill bit 10 and body 12 rotates the fins 36 and 38 and the legs 26 and roller bits 34.

Referring now to FIGS. 1 and 4, it is to be noted that the body 12 includes a longitudinal axial opening 60 and one or more longitudinal passageways 62 exteriorly of the body positioned between adjacent legs 26. Thus, a fluid such as air may be inserted through a drill string through the axial opening 60 out the bottom of the body 12 and returned up the passageways 62 for removing cuttings from the blast hole while drilling.

Figure 6:
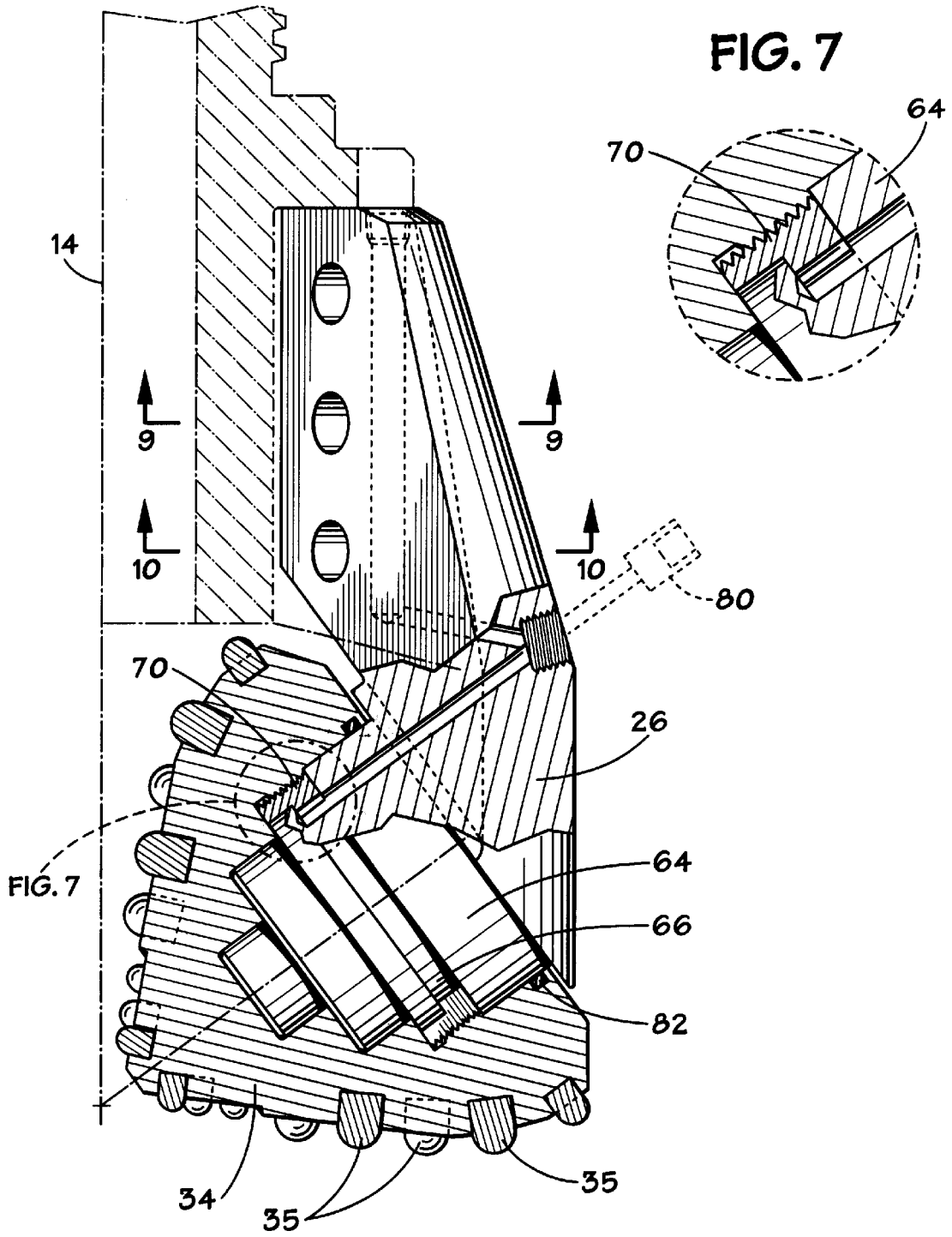
FIG. 6 is a fragmentary elevational view, partly in cross section, illustrating the relative positions of the body, a leg and a roller bit.
Figure 8:
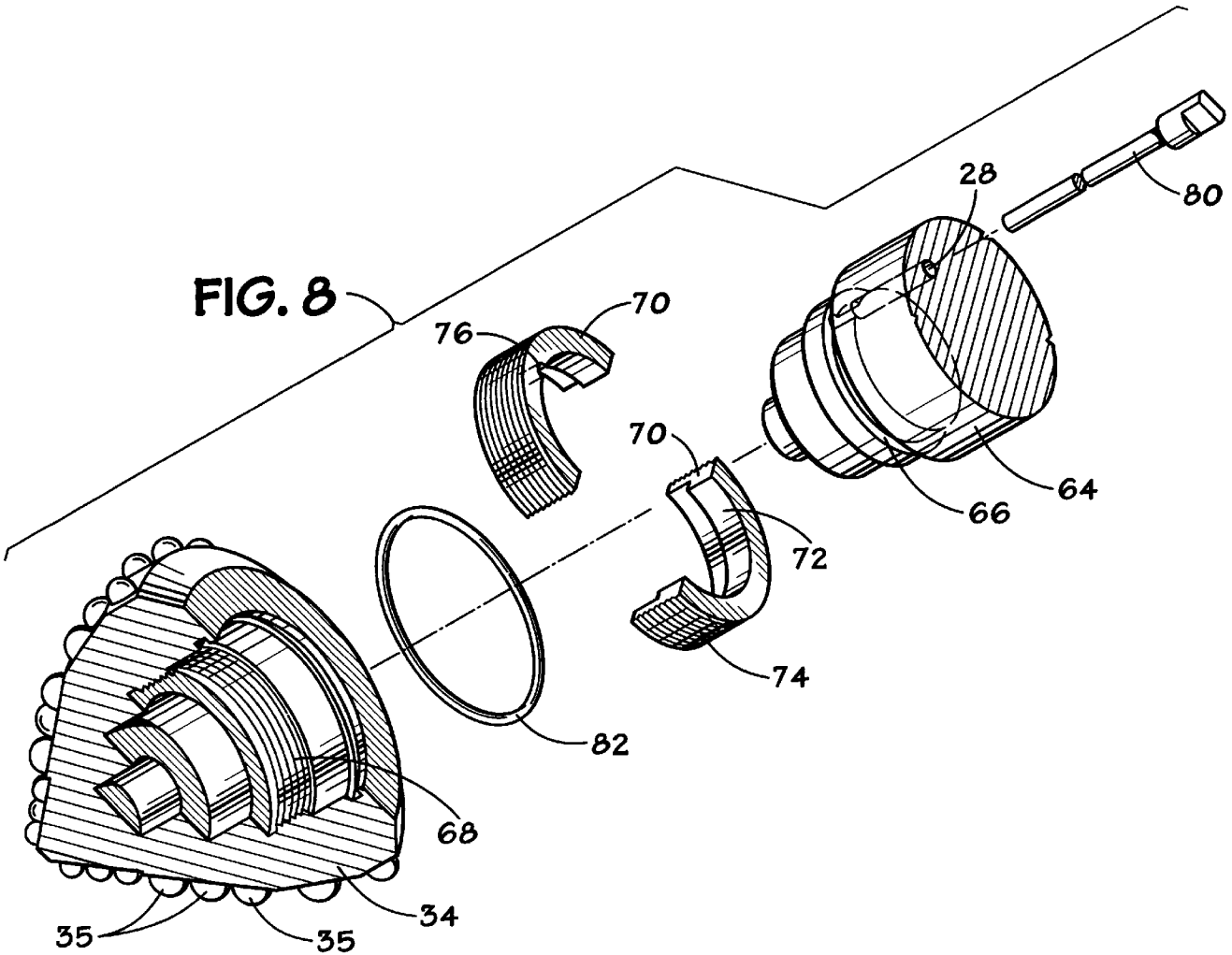
FIG. 8 is an exploded fragmentary view of the parts for releasably connecting a roller bit to a leg.

Referring now to FIGS. 6, 7 and 8, one type of means for releasably connecting the roller bits 34 to the supporting legs 26 is best seen. A hub 64 is connected to the second end of the support legs 26 and includes a recess 66. The interior of the roller bit 26 includes an interior thread 68. A split ring 70 includes an engaging shoulder 72 for engaging the recess 66 on the member 64 and also includes threads 74 for threadably engaging the threads 68 on the roller bit 34. In addition, one of the split rings 70 includes a notch 76 which may be aligned with a passageway 78 in the member 64. Thus, the shoulder 72 on the ring segments 70 are inserted into the recess 66, the roller bit 26 placed over the segment 70 and rotated while a pin 80 is inserted into the passageway 28 to engage the notch 76 to hold the segment 70 relative to the internal threads 68 for tightening the roller bit 26 in place. Preferably, an O-ring 82 is previously inserted to protect the bearings inside of the roller bit 34. The pin 80 is removed and the passageway 28 plugged. The passageway 28 may be connected to oil inlets 86 in the legs 26.

As previously mentioned, the rotary mine drilling bit 10 of the present invention can be easily inspect between drilling of the blast holes and the wearable parts such as the drilling bits 34 and supporting legs 26 and bolts 28 may be field repaired thereby prolonging the useful life of the bit 10 and decreasing the expense of drilling.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A rotary mine drilling bit comprising, a body having a longitudinal axis, a first end of the body having a connection for attachment to a drill string, a second end of the body having a plurality of longitudinally extending slots on the periphery of the second end, a transversely extending thrust shoulder on the body intermediate the ends of the body, a longitudinally extending supporting leg positioned in each of the slots, one end of the supporting legs positioned to engage the thrust shoulder for receiving a longitudinal thrust of the body from a drill string, a roller bit connected to a second end of each supporting leg, said slots are formed by first and second longitudinally extending fins extending outwardly from the body in a diverging direction from each other forming diverging shoulders on opposite sides of each slot, said supporting legs include diverging sides for mating with coacting diverging sides for mating with coacting diverging shoulders when the legs are positioned in one of the slots, a plurality of connecting bolts for releasably connecting each leg in a slot, said bolts extending through the diverging sides of said legs through openings in the legs and through openings in the diverging shoulders of the fins, said openings in the legs and said openings in the fins being larger than the periphery of the bolts for allowing longitudinal movement of the legs in the slots for allowing the one end of the legs to engage the thrust shoulder whereby the bolts avoid thrust forces on the body while drilling.

2. The drill bit of claim 1 wherein the angle included between first and second fins is approximately ninety degrees.

3. The drill bit of claim 1 wherein each of the legs includes an inside which is spaced from contact with the body thereby insuring mating of the diverging sides of the legs with coacting diverging shoulders of the slots.

4. The drill bit of claim 1 wherein the body is an integral one piece.

5. The drill bit of claim 1 wherein each bolt extends through only one side of a leg.

6. The drill bit of claim 1 wherein each bolt extends through a side of two adjacent legs.

* * * * *